United States Patent [19]

Miesen

[11] Patent Number: 4,674,764

[45] Date of Patent: Jun. 23, 1987

[54] TRACTION DEVICE FOR SKIS

[75] Inventor: Michael P. Miesen, Missoula, Mont.

[73] Assignee: Lines West, Missoula, Mont.

[21] Appl. No.: 635,725

[22] Filed: Jul. 30, 1984

[51] Int. Cl.[4] ..... A63C 7/10

[52] U.S. Cl. ..... 280/604; 280/605

[58] Field of Search ..... 280/604, 605, 608, 809

[56] References Cited

U.S. PATENT DOCUMENTS

| | | | |
|---|---|---|---|
| 1,783,833 | 12/1930 | Elsner | 280/604 |
| 2,120,363 | 6/1938 | Jerns, Jr. | 280/605 |
| 2,289,459 | 7/1942 | Rydberg | 280/605 |
| 2,358,213 | 9/1944 | Courage | 280/605 |
| 2,844,380 | 7/1958 | Tribelhorn | 280/604 |
| 3,582,101 | 6/1971 | Ste. Marie | 280/604 |
| 3,927,896 | 12/1975 | Detoia | 280/605 |
| 4,027,895 | 6/1977 | Larsson | 280/604 |

FOREIGN PATENT DOCUMENTS

| | | | |
|---|---|---|---|
| 82921 | 5/1920 | Austria | 280/608 |
| 559386 | 9/1932 | Fed. Rep. of Germany | 280/604 |
| 2937574 | 4/1981 | Fed. Rep. of Germany | 280/604 |
| 7909011 | 7/1981 | Netherlands | 280/604 |

*Primary Examiner*—David M. Mitchell

*Attorney, Agent, or Firm*—Wells, St. John & Roberts

[57] ABSTRACT

A traction device for skis moves in response to forward and rearward thrusting motion of the ski to selectively engage the snow or ice surface to prevent rearward sliding motion of the ski and disengage to allow free forward sliding motion of the ski. The device is cammed between operative and inoperative position in response to the forward and rearward thrusting motions of the ski. A tooth arrangement can also be provided to swing between operative and inoperative positions similar to that of the traction member. The tooth device can also be pivoted to a position wherein the traction device is locked in an operative position. In this situation, the traction device operates continuously in forward as well as backward motions of the ski. The operative traction member acts in forward motion, as a braking device to slow forward progress.

13 Claims, 3 Drawing Figures

TRACTION DEVICE FOR SKIS

FIELD OF THE INVENTION

The present invention relates to mechanical traction enhancement for snow skis.

BACKGROUND OF THE INVENTION

Cross-country skiing differs substantially from downhill skiing in that the course for the cross-country skier is not always downhill. In fact, cross-country skiers are often faced with the problem of how to ski uphill. This problem has led to the development of many wax concoctions that can be applied to selectively increase or decrease the frictional grip between the ski bottom runners and the snow surface. Some mechanical appliances have also been developed to enhance traction of skis.

Both approaches have had serious drawbacks. Wax is difficult and time consuming to apply. It is very temperature dependent so slight temperature changes can render some waxes useless. The skier must then stop, remove the skis, scrape the old wax from the skis and apply a different formula wax for the particular temperature. By this time, the temperature may have changed again. Some waxes are best suited for wet snow while other waxes are suited for dryer snow. Additionally, wax that gives good traction climbing uphill has an adverse effect when the skier wants less traction in a downhill run.

Mechanical appliances would seem to be a solution to the difficulties presented with application of wax to cross-country ski runners. One solution has been the "fish scale" surface provided on many forms of cross-country ski runners. The "scales" theoretically allow a relatively free sliding motion in a forward direction while gripping the snow surface to prevent rearward sliding motion of the ski. The quantity of these scales required to produce a desirable effect, however, results in a higher coefficient of friction for forward sliding motion than what normally may be desired. Furthermore, the surface will wear and cannot be easily replaced or reconditioned. When the "fish scale" ski runners wear down, the skis must usually be disposed of. This is both wasteful and expensive to the skier.

U.S Pat. No. 4,027,895 to Larsson discloses a cross-country ski having alternate sliding and holding surfaces. This is a specially designed ski having two separate runner surfaces. One surface may be elevated above the other when not in use and subsequently lowered to engage the snow while the other is simultaneously raised. Both runner surfaces are covered with a "grease" or wax typically used for normal cross-country skis. One surface is covered with a high friction "grease" while the other with a low friction material. The surfaces alternately engage and disengage the ground of snow surface due to action of the skier in raising and lowering his or her heel.

U.S. Pat. No. 1,783,833 to Elsner discloses a strap-on, non-slip device used with skis. This device can be attached and removed selectively from skis. When attached, the device functions constantly to provide a high friction surface on the ski runners.

A mechanical climbing and braking device for skis is disclosed by Tribelhorn in U.S. Pat. No. 2,844,380. This is a relatively complex inset mechanism for skis using springs, cams, and lever mechanisms. The lever mechanisms can be operated to shift traction members to operative positions projecting from the bottom surfaces of the ski or to inoperative positions retracted within housings on the ski. The traction devices work against motion of the ski in both foward and rearward directions. In the forward direction the traction devices work as brakes to slow foward progress of the skier. The skier must release the traction devices and retract them to inoperative positions before the ski can slide freely in the forward direction. But, the ski is also free to slide rearwardly when the traction devices are retracted.

U.S. Pat. No. 2,120,363 to Jerns discloses a traction device that is stored on the top of a ski and can be shifted from a storage position at the top of the ski to an operative position projecting downwardly into the snow beneath the ski. A locking arrangement will secure the traction device in either the operative or inoperative positions.

A ski and snowshoe device is disclosed in U.S. Pat. No. 3,927,896 to Detoia. The traction device used here is integral with the ski and includes traction members that can be pivoted through openings in the ski downwardly to engage the snow surface. The traction devices are actuated by pressing a lever downwardly and are lifted by releasing a latch to allow the devices to swing back upwardly to inoperative positions. A somewhat similar upward or downward latching traction mechanism is disclosed in U.S. Pat. No. 3,582,101 granted to Roger Ste. Marie.

An improved mechanical device is disclosed in U.S. Pat. No. 2,358,213 to Courage. Mr. Courage discloses a traction device for skis that pivot in response to motion of the ski in forward and rearward directions. When the ski is moved forwardly, the traction device will swing upwardly and engage the bottom runner surface of the ski where it will produce less drag. Then, when the ski is thrust rearwardly, the device will pivot downwardly to an operative position to dig into the snow, preventing rearwardly sliding motion of the ski. The device is removable from the ski due to the forward drag it presents by obstructing the smooth bottom runner surface of the ski when in place.

Of the above references, none have provided a completely satisfactory solution to the problem of providing maximum traction while skiing on flat ground or uphill situations and minimum traction while skiing downhill. The wax arrangements are difficult and temperature dependent while the mechanical appliances produce additional drag during the downhill run. The problem therefore has remained of obtaining some form of traction device for skis that will resist rearward sliding motion of the ski while allowing free forward sliding motion thereof.

BRIEF DESCRIPTION OF THE DRAWINGS

The present invention is illustrated in the accompanying drawings, in which.

DETAILED DESCRIPTION OF THE PREFERRED EMBODIMENT

In compliance with the constitutional purpose of the Patent Laws "to promote the progress of science and useful arts" (Article 1, Section 8), applicant submits the following disclosure of the invention.

Figure 1:
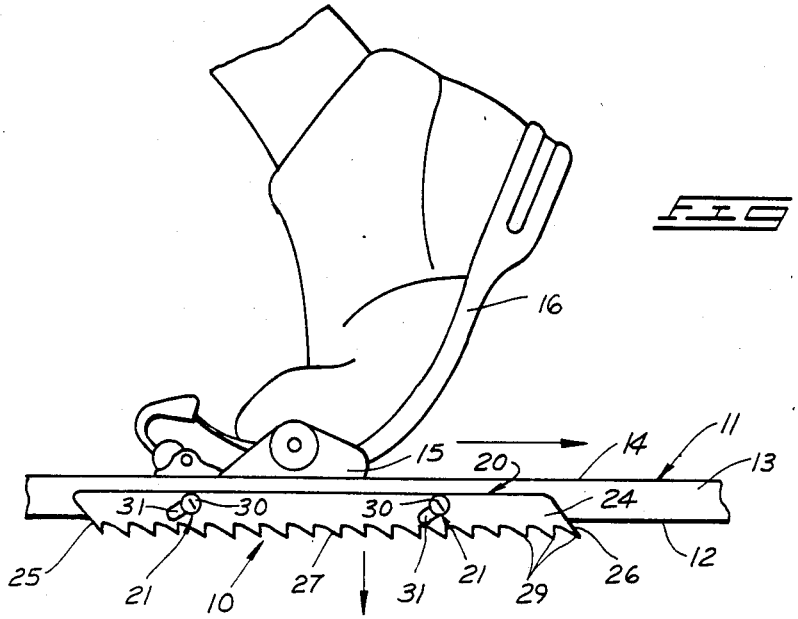
FIG. 1 is a pictorial view illustrating a first form of the present traction device and showing one operational position thereof in relation to a ski and the boot of a skier.
Figure 2:
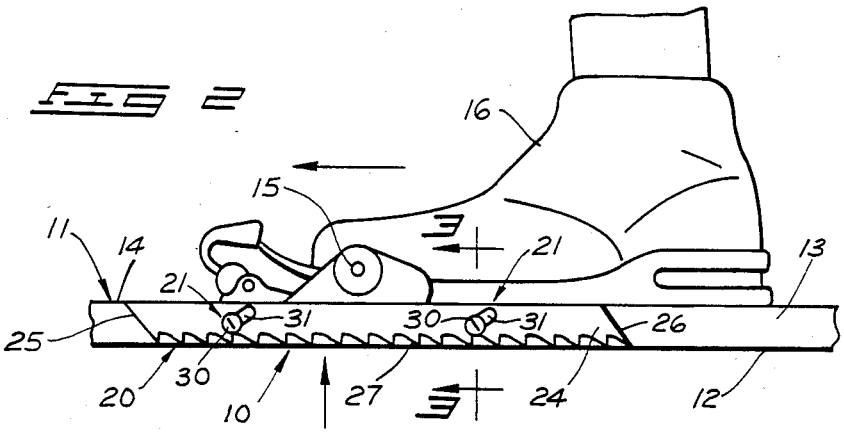
FIG. 2 is a view similar to FIG. 1 only showing a different operational position of the elements therein.
Figure 4:
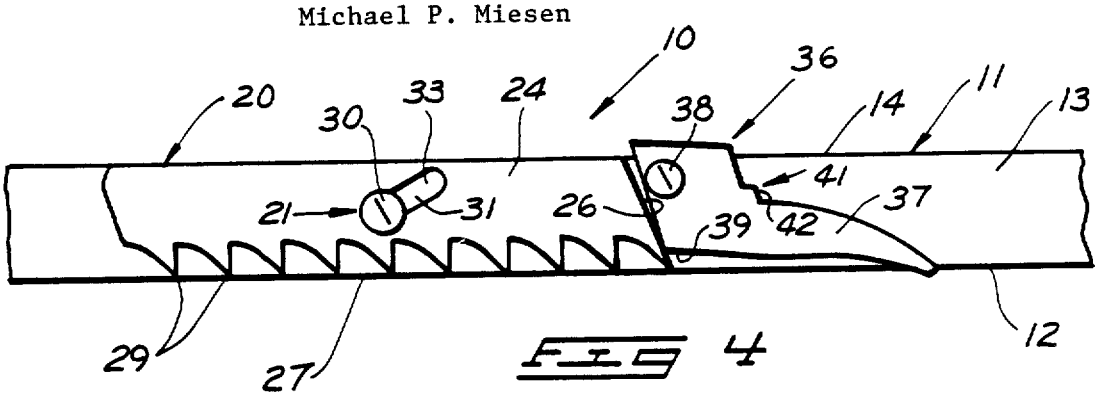
FIG. 4 is a fragmented view showing another form of the present traction device in a forward sliding mode.
Figure 5:
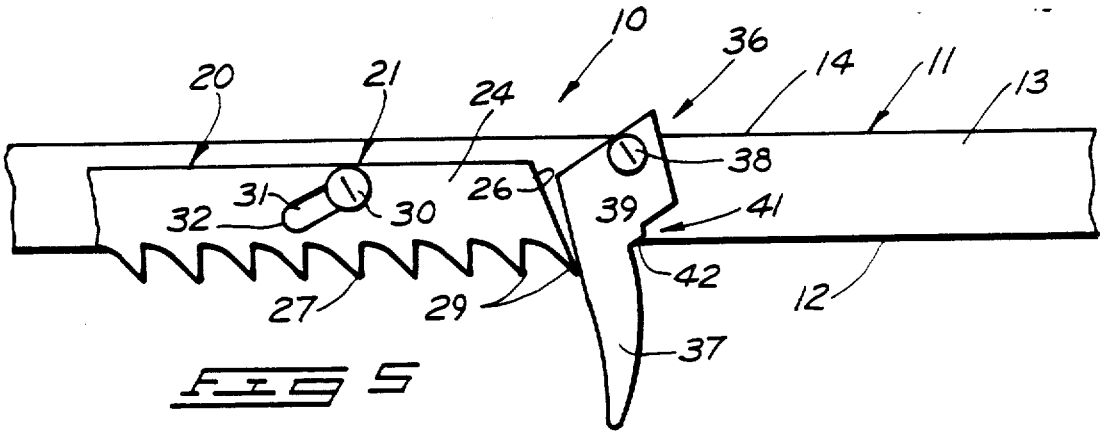
FIG. 5 is a view similar to FIG. 4 only showing the traction components in an operative mode resisting rearward sliding motion of the ski.
Figure 6:
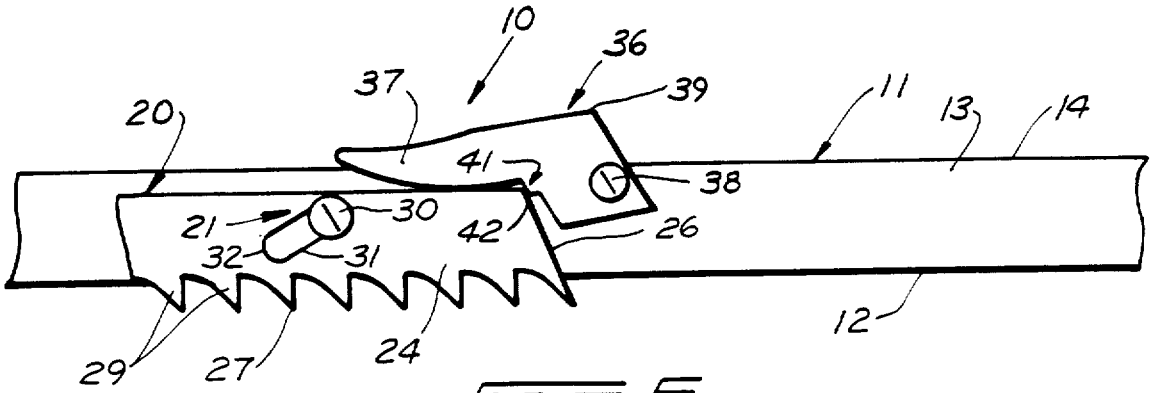
FIG. 6 is a view similar to FIGS. 4 and 5 only showing one of the traction elements locked in a downward operative position to act as a brake for producing drag during downhill skiing.

The present traction device is generally designated by the reference numeral 10 in the accompanying drawings. There are two forms of the device 10 illustrated. A first form is illustrated in FIGS. 1 and 2 while a second form is illustrated in FIGS. 4–6. Both forms are attachable to a ski 11. In fact, it is preferable to provide the present device in pairs such that one can be mounted to each ski.

For purposes of further description below, the ski 11 is to be understood as including a relatively flat longitudinal bottom runner surface 12 extending between upright parallel and opposed side edges 13. A top surface 14 is spaced above the runner 12 and includes a binding 15 for releasably securing a ski boot 16. The bottom runner 12 is the surface that engages and slides across the snow or ice surface.

The present device 10 can be provided as an integral part of the ski 11 or as an attachment thereto. The device 10 is used in either regard to present resistance to rearward sliding motion of the ski while allowing relatively free forward sliding motion thereof.

Both forms of the device include a rigid traction member 20. The rigid traction member is mounted by means 21 to the ski. Means 21 is responsive to forward and rearward thrusting motions of the ski. Upon rearward thrusting motion of the ski, means 21 will serve to move the traction member to an operative position frictionally engaging the snow or ice surface alongside the runner. When the ski is thrust forwardly, the means 21 will move the traction member to an inoperative position and allow free forward sliding motion of the ski.

The rigid traction member 20 may be comprised of an elongated bar 24. The bar may include a inclined front end spaced toward the front or tip of the ski and a rearwardly spaced inclined rear end 26. A vertical side surface 23 of bar 24 slidably engages the adjacent ski side edge 13. The two surfaces cooperate to keep movement of the bar within a vertical plane.

A bottom traction surface 27 extends the full length of bar 24 between the ends 25 and 26. The traction surface 27 shown in the drawings is comprised of a row of rearwardly inclined gripping teeth 29. Other surfaces or tooth configurations may also be used.

Figure 3:
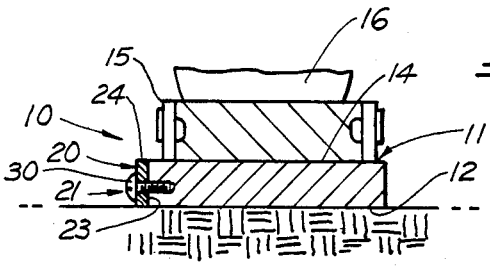
FIG. 3 is a sectional view taken along line 3—3 in FIG. 2.

Means 21 may include a pair of transverse pins 30 extending from the ski 11. Pins 30 may be secured to the ski along the side edges 13 thereof. They are slidably received in inclined slots 31 formed in the bar member 24. The slots 31 are parallel and extend from bottom ends 32 (FIGS. 5 and 6) upward and rearwardly to top ends 33 (FIG. 4). The angled slots function against the pins as the bar moves translationally between a downward operative position shown in FIGS. 1, 5, and 6, and an upward inoperative position as shown in FIGS. 2, 3, and 4.

Translational sliding motion of the bar between the inoperative and operative position is effected by forward and rearward thrusting motion of the ski. FIG. 1 illustrates the motions by which the bar is moved to the operative position. Here the skier is thrusting his or her foot and leg rearwardly to drive the body and other leg forwardly as in a running or walking motion. The rearward thrusting motion of the ski causes the pins 30 to slide upwardly along the slots 31. The bar then slides downwardly and at the gripping surface is driven into the snow or ice surface to resist rearward sliding motion of the ski. The rearwardly thrust foot is thus provided with sufficient traction by the bar in its operative position to allow the skier to thrust his other foot forwardly.

The forwardly thrust foot is shown in FIG. 2. Here, the ski 11 is moving forwardly in response to forward thrusting motion of the skiers foot and leg. As the ski moves forwardly, the pins 30 move forwardly within the inclined slots 31, such that the slots cam against the pins and lift the bar upwardly. The gripping surface therefore disengages the snow or ice and presents little if any frictional resistance to forward motion for the ski.

FIGS. 4–6 illustrate a form of the present device making use of a rigid tooth member 36. The rigid tooth member 36 is pivotably mounted to the ski by a pin 38. The tooth member includes a shank 37 that extends outwardly and pivots about the pin 38 between inoperative positions as shown in FIGS. 4 and 6 and an operative position shown in FIG. 5. The tooth 36 is mounted to the ski rearward of the bar end 26 such that a surface 39 thereon will engage and pivot in response to movement of the bar. Thus, when the ski is thrust forwardly, the bar will slide in a rearward direction and cause the tooth 36 to swing rearwardly to its inoperative position. Then, when the ski is thrust rearwardly again, the snow will engage the tip of the shank 37 and the tooth will pivot downwardly to its operative position, resisting rearward motion of the ski. Surface 39 and bar end 26 will abut at the operative position shown in FIG. 5 and prevent the tooth from pivoting on forwardly past its operative position.

A lock means 41 is provided between the rigid tooth 36 and bar 24. Lock means 41 includes a surface 42 on tooth 36 that is selectively engageable with the rear bar end 26.

The skier may swing the tooth shank in a rearward and upward motion, pivoting it over center to the FIG. 6 position. With a little applied force, the surface 42 will snap into an over-center relationship against the bar end 26, locking it in its operative position. The bar will therefore remain in the operative position regardless of forward or rearward motion of the ski. This position is used where the skier does not wish to progress at full speed in a downhill run but would prefer to use the traction surface as a braking device to decrease the downhill speed. When it is no longer desirable to use the bar as a braking device, the tooth shank can simply be lifted to allow pivotal motion thereof back to the FIG. 4 or 5 positions. It is noted that during normal progress the tooth will pivot in response to motion of the skis and traction member 20 between the FIG. 4 and FIG. 5 positions depending upon the forward or rearward thrust motion involved.

The means 21 for mounting the traction member to the ski has been described in terms of the pins 30 and 38 being rigidly secured to the ski and the slots 31 being formed in the bar 24. However, it is conceivable, especially in the case of skis being manufactured with the present traction device in place, that the pins be secured to the bar and tooth member and the slots 31 be supplied integrally within the ski.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A traction device for a ski having a low friction bottom runner between opposed longitudinal side edges, for allowing a skier to slide forwardly over a snow or ice surface and minimizing rearward sliding, said traction device comprising:

an elongated rigid traction member having a longitudinal elongated traction surface along a bottom edge thereof; and means for slidably mounting the traction member to the ski adjacent a side edge thereof and alongside the runner for free sliding translational motion along a side edge of the ski between an operative position wherein the traction surface projects downwardly beyond and parallel to the bottom runner of the ski and an inoperative position wherein the traction surface is situated parallel to and above the bottom runner, said means being responsive to forward and rearward thrusting motions of the ski to (a) move the traction member to the inoperative position allowing forward sliding motion of the ski and (b) move the traction member to the operative position to frictionally engage the snow or ice surface alongside the runner in response to rearward thrusting of the ski.

2. The traction device of claim 1 wherein the rigid reaction member includes an elongated bar for sliding engagement with the side edge of the ski and longitudinal toothed bottom edge for engaging the snow or ice surface.

3. The traction device of claim 1 further comprising:

a rigid tooth member pivotably mounted to the side edge of the ski;

lock means on the tooth member for selectively locking the traction member in the operative position.

4. The traction device of claim 1 wherein said means includes:

pins for attachment to the ski along a side edge thereof with shanks projecting laterally outward therefrom; and inclined slots formed in the traction member for slidably receiving the pins.

5. The traction device of claim 4 wherein the slots include slot walls that are inclined from forward ends adjacent the ski runner to top ends spaced upwardly therefrom in relation to the runner such that the slot walls will (a) cam upwardly against the pins upon forward thrusting motion of the ski and cause the traction member to shift to its inoperative position, and (b) cam downwardly against the pins upon rearward thrusting motion of the ski and cause the traction member to shift to its operative position.

6. The traction device of claim 5 further comprising a rigid tooth member pivotably mounted to the side edge of the ski and;

lock means on the tooth member for selectively locking the traction member in the operative position.

7. The traction device of claim 6 wherein the rigid tooth is mountable to the ski along a side edge thereof for forward pivotal movement to an operative position in response to rearward thrusting motion of the ski and rearward pivotal movement to an inoperative position clear of the snow or ice surface in response to forward thrusting motion of the ski.

8. The traction device of claim 7 further comprising an abutment surface on the traction member for engagement with the rigid tooth at the operative position thereof to prevent forward pivotal motion of the tooth beyond its operative position.

9. The traction device as claimed by claim 1 further comprising lock means mountable to the ski adjacent the traction device for selectively locking the tracting member in its operative position.

10. A snow ski having a traction device to resist rearward sliding movement of the ski over a snow or ice surface and to allow free forward sliding movement thereof, said ski including:

parallel edges extending longitudinally along the length of said ski on opposite sides of a downwardly facing bottom runner surface;

an elongated bar having an elongated bottom traction surface parallel to the bottom runner surface of the ski;

means mounting the bar to the ski for selectively urging the bar downwardly responsive to rearward thrusting motion of the ski to an operative position where the elongated traction surface may frictionally engage the snow or ice surface along the length thereof and upwardly to an inoperative position responsive to forward motion of the ski where the traction surface is spaced upwardly clear and parallel to the bottom runner surface; and wherein the means is comprised of interfitting parallel slots and pins on the bar and ski and wherein the slots include slot walls that are inclined to cam against the pins to lift or lower the bar in response to forward and rearward thrusting motions of the ski.

11. The snow ski of claim 10 wherein the pins are affixed to the ski and the slots are formed in the bar.

12. The snow ski of claim 11 wherein the bar is slidably mounted to the ski alongside one edge thereof.

13. A traction device for a ski having a low friction bottom runner between opposed longitudinal side edges for allowing a skier to slide forwardly over a snow or ice surface and for minimizing rearward sliding of said ski, said traction device comprising:

an elongated rigid traction member having a bottom traction surface thereon;

means for slidably mounting the traction member to the ski adjacent a side edge thereof and alongside the bottom runner responsive to forward and rearward thrusting motions of the ski to (a) translationally move the traction member to an inoperative position allowing forward sliding motion of the ski in response to forward thrusting motion of the ski and (b) translationally move the traction member to an operative position to frictionally engage the snow or ice surface alongside the runner in response to rearward thrusting of the ski;

wherein said means includes pins for attachment to the ski along a side edge thereof with shanks projecting laterally outward therefrom;

wherein the slots include slot walls that are inclined from forward ends adjacent the ski runner to top ends spaced upwardly therefrom in relation to the runner such that the slot walls will (a) cam upwardly against the pins upon forward thrusting motion of the ski and cause the traction member to shift to its inoperative position and (b) cam downwardly against the pins upon rearward thrusting motion of the ski and cause the traction mem ber to shift to its operative position;

a rigid tooth member pivotably mounted to the side edge of the ski;

lock means on the tooth member for selectively locking the traction member in its operative position; and an abutment surface on the traction member for engagement with the rigid tooth at the operative position of said rigid tooth to prevent forward pivotal motion of the tooth beyond its operative position.

* * * * *

UNITED STATES PATENT AND TRADEMARK OFFICE

CERTIFICATE OF CORRECTION

PATENT NO. : 4,674,764

DATED : June 23, 1987

INVENTOR(S) : Michael P. Miesen

It is certified that error appears in the above-identified patent and that said Letters Patent is hereby corrected as shown below:

The sheet of drawing consisting of FIGS. 4, 5 and 6 should be added as shown on the attached sheet.

Signed and Sealed this

First Day of March, 1988

*Attest:*

*Attesting Officer*

DONALD J. QUIGG

*Commissioner of Patents and Trademarks*

Michael P. Miesen